United States Patent [19]

Godfrey

[11] Patent Number: 4,471,962

[45] Date of Patent: Sep. 18, 1984

[54] ARROWHEAD FOR ARCHERY GOLF ARROW

[76] Inventor: Harold P. Godfrey, 1000 Goodlander Cir., Selah, Wash. 98942

[21] Appl. No.: 507,671

[22] Filed: Jun. 24, 1983

[51] Int. Cl.[3] ..... F41B 5/02

[52] U.S. Cl. ..... 273/419; 273/411

[58] Field of Search ..... 273/416, 418–422, 273/411; D22/12

[56] References Cited

U.S. PATENT DOCUMENTS

| | | | |
|---|---|---|---|
| D. 232,731 | 9/1974 | Altier | D22/12 |
| 2,350,581 | 6/1944 | Boose | 273/420 X |
| 2,490,470 | 12/1949 | Racine | 273/416 X |
| 2,620,190 | 12/1952 | Bean | 273/418 X |
| 2,873,973 | 2/1959 | Hauch | 273/421 |
| 2,925,277 | 2/1960 | Blanchette et al. | 273/420 |
| 3,012,786 | 12/1961 | Saunders | 273/420 |
| 3,241,836 | 3/1966 | Zwickey | 273/419 |

OTHER PUBLICATIONS

Bowhunter Magazine, 2/2–1978, vol. 7, No. 3, p. 50, "Eliminator".

Tetra Mold and Tool Inc. Circular, "Eliminator".

*Primary Examiner*—Paul E. Shapiro

*Attorney, Agent, or Firm*—Harvey B. Jacobson

[57] ABSTRACT

A generally cylindrical body is provided having first and second ends and the first end includes attaching structure for attaching the body to the forward end of an arrow shaft. The second end of the body includes circumferentially spaced endwise outwardly projecting elongated ground spike portions including outer side surfaces extending longitudinally of the head and forming endwise outward continuations of the corresponding sides of the body and inner side surfaces which incline endwise outwardly toward the outer end apex portions of said ground spike portions formed by at least substantial intersection of said outer side and inner side surfaces.

8 Claims, 6 Drawing Figures

ARROWHEAD FOR ARCHERY GOLF ARROW

BACKGROUND OF THE INVENTION

Recently interest has increased in an archery game called "Archery Golf" wherein a golf-like game is played with a bow and arrow. In this game a starting area is defined and the players of the game shoot arrows toward a target area which may be sufficiently distant to require the equivalent of a long (tee) first shot, a second (approach) shot and a third target shot. Although a first long shot may be carried out with a conventional arrow inasmuch as the arrow will descend toward the earth at a reasonably great angle, when making approach shots and final target shots, the arrow approaches the ground at a small angle thereto and will often "skip" upon contact with the ground instead of penetrating the ground. Accordingly, a need exists for an arrowhead specifically designed for use in an archery golf game and which will enable the arrow to penetrate the ground and thus prevent "skipping" when the arrow approaches the ground at a small angle relative thereto.

Examples of various forms of arrowheads including some of the general structural and operational features of the instant invention are disclosed in U.S. Pat. Nos. 2,554,012, 2,937,873, 2,939,708 and 3,164,385.

BRIEF DESCRIPTION OF THE INVENTION

The arrowhead of the instant invention includes endwise outwardly projecting, forwardly tapering and circumferentially spaced ground spike portions whose outer sides form lengthwise continuations of the corresponding sides of the body of the arrowhead and whose inner sides are inclined forwardly and outwardly toward apex portions defined by at least substantial intersecting with the forward extremities of the outer sides of the spike portions. With this type of construction, the arrowheads are capable of penetrating even hard ground when an associated arrow approaches the ground at a very small angle relative thereto in order in prevent "skipping" of the arrow.

The main object of this invention is to provide an arrowhead specifically designed to prevent "skipping" of an arrow as it approaches the ground at a small angle relative thereto.

Another important object of this invention is to provide an improved arrowhead specifically designed for use in an archery golf game.

Yet another important object of this invention is to provide an archery golf arrowhead of the interchangeable type.

A further object of this invention is to provide an arrowhead which may be constructed of various materials.

A final object of this invention to be specifically enumerated herein is to provide an arrowhead in accordance with the preceding objects and will conform to conventional forms of manufacture, be of simple construction and dependable in operation so as to provide a device that will be economically feasible, long lasting and relatively trouble free.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
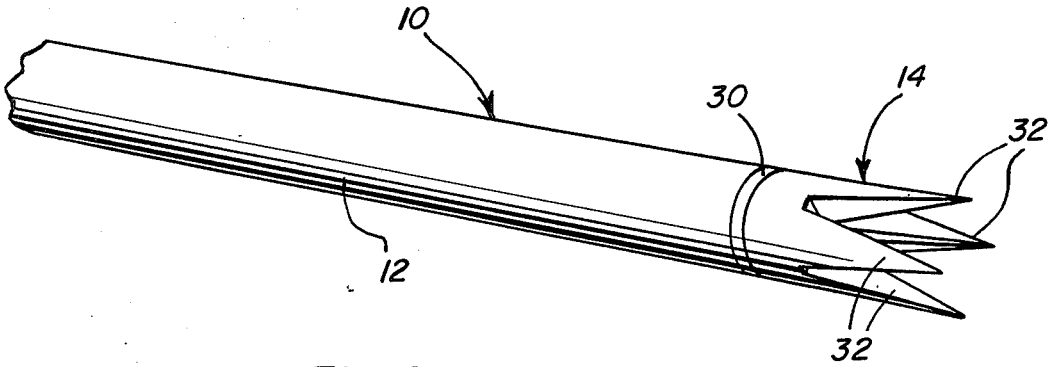
FIG. 1 is a fragmentary prospective view of the head end of a conventional arrow shaft with the first form of the arrowhead of the instant invention supported therefrom.
Figure 2:
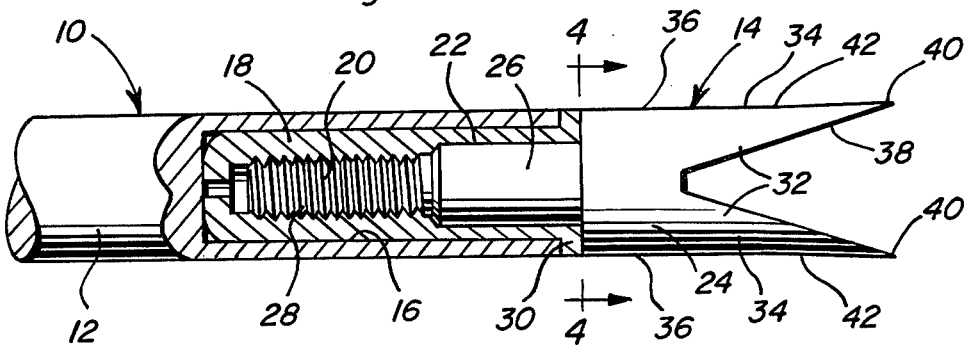
FIG. 2 is an enlarged fragmentary side elevational view of the assemblage illustrated in FIG. 1 and with portions of the arrow shaft and arrowhead supporting insert being broken away and illustrated in vertical section.
Figure 3:
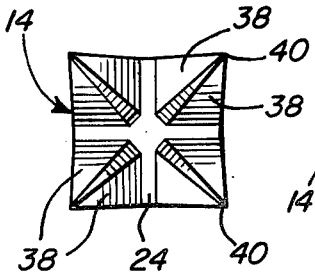
FIG. 3 is a front end elevational view of the arrowhead illustrated in FIGS. 1 and 2.
Figure 4:
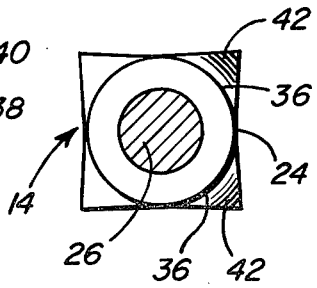
FIG. 4 is a transverse sectional view taken substantially upon the plane indicated by the section line 4—4 of FIG. 2.

Referring now more specifically to the drawings, the numeral 10 generally designates an arrow including a conventional arrow shaft 12 and an arrowhead referred to in general by the reference numeral 14 and constructed in accordance with the present invention.

The head end of the arrow shaft 12 includes an axial blind bore 16 formed therein and a shouldered tubular insert 18 is secured within the bore 16. The insert 18 is provided with a threaded longitudinal bore 20 including a smooth forward end counterbore 22 opening endwise outwardly of the shouldered forward end of the insert 18.

The first form of arrowhead 14 includes a cylindrical body 24 provided with an axially rearwardly extending smooth shank 26 terminating rearwardly in a diametrically reduced threaded shank portion 28. The shank portion 28 is threaded into the longitudinal bore 20 and the shank 26 is received in the counterbore 22 with the rear side of the body 24 abutted against the end flange 30 of the insert 18.

The arrowhead 14 includes a plurality of circumferentially spaced endwise outwardly projecting and forwardly tapering elongated ground spike portions 32 and each ground spike portion includes an outer side 34 of generally partial cylindrical configuration forming an endwise outward extension corresponding side portion 36 of the body 24. The ground spike portions 32 include inclined inner surfaces 38 and the outer and inner surfaces 34 and 38 converge toward forward end apex portions 40 of the ground spike portions 32. The forward portions of the ground spike portions 32 may be slightly outwardly deflected as at 42.

Figure 5:
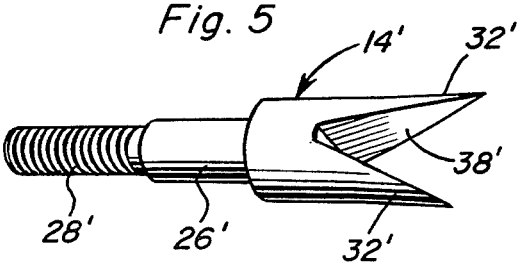
FIG. 5 is a perspective view of a second form of arrowhead constructed in accordance with the present invention.
Figure 6:
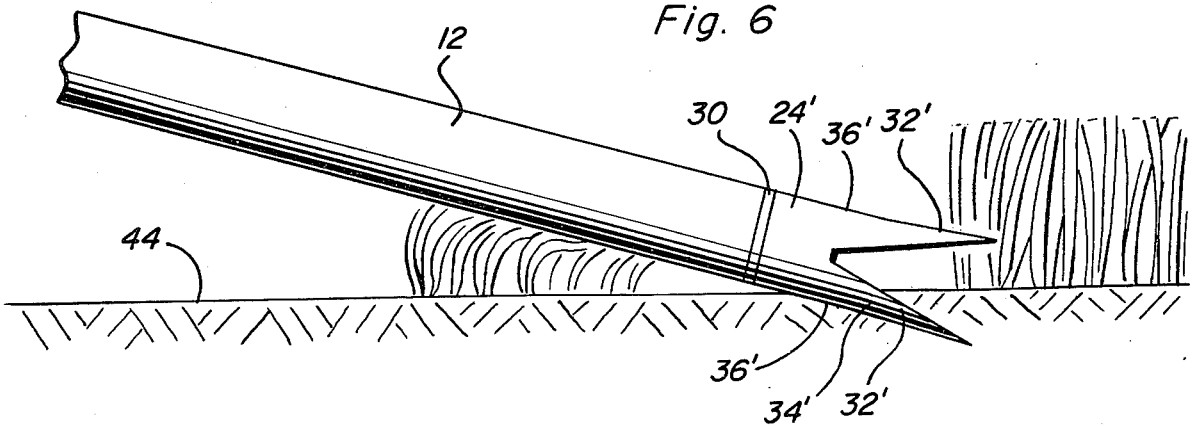
FIG. 6 is a side elevational view of the head end of an arrow shaft supporting the second form of arrowhead and illustrating the manner in which the arrowhead may penetrade the ground when the arrow shaft approaches the ground at a small angle relative thereto.

With attention now invited more specifically to FIGS. 5 and 6, there may be seen a modified form of arrowhead referred to in general by the reference numeral 14' and which is similar in many respects to the arrowhead 14 and has the various components thereof corresponding to similar components of the arrowhead 14 designated by prime reference numerals corresponding to the reference numerals given the various similar components of the arrowhead 14. The arrowhead 14 includes four ground spike portions 32, but the arrowhead 14' includes only a pair of ground spike portions 32'. Nevertheless, as illustrated in FIG. 6, the ground spike portions 32' are fully operative to penetrate the ground 44 even when the associated arrow shaft 12 is inclined only slightly relative to the surface of the ground 44.

It is to be noted that although the arrowhead 14 includes four ground spike portions 32 and the arrowhead 14' includes two ground spike portions 32', an arrowhead construction in accordance with the present invention may include three, five or more ground spike portions. In addition, each ground spike portion so provided may have its forward end slightly laterally outwardly deflected. In addition, the arrowheads 14 and 14' may be constructed of various different materials and, of course, may be interchanged or replaced when desired.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An arrowhead for an archery golf arrow, said arrowhead including a generally cylindrical body having first and second ends, said first end including attaching means for attaching said body to the forward end of an arrow shaft, said second end including circumferentially spaced endwise outwardly projecting elongated ground spike portions including outer sides extending longitudinally of said arrowhead and forming endwise outward extensions of the corresponding sides of said body and inner side surfaces which incline outwardly toward outer end apex portions of said ground spike portions formed by substantial intersections between said outer sides and said inner side surfaces.

2. The arrowhead of claim 1 wherein said arrowhead includes two equally circumferentially spaced ground spike portions.

3. The arrowhead of claim 1 wherein said arrowhead includes four circumferentially spaced ground spike portions.

4. The arrowhead of claim 1 wherein said ground spike portions each include a single substantially planar inner side surface.

5. The arrowhead of claim 1 wherein each of said ground spike portions includes a pair of inner side surfaces disposed at generally 90° relative to each other.

6. The arrowhead of claim 5 wherein said arrowhead includes four circumferentially spaced ground spike portions.

7. The arrowhead of claim 1 wherein said attaching means includes an axially endwise outwardly projecting threaded shank portion carried by said first end of said body.

8. The combination of claim 7 wherein said arrowhead includes four circumferentially spaced ground spike portions.

* * * * *